US012429297B2

(12) United States Patent
Lehr

(10) Patent No.: US 12,429,297 B2
(45) Date of Patent: Sep. 30, 2025

(54) TRIGGER ARRANGEMENT FOR MANUAL AND REMOTE FIRING

(71) Applicant: United States of America, Department of the Navy, Dahlgren, VA (US)

(72) Inventor: Matthew D. Lehr, King George, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 190 days.

(21) Appl. No.: 18/449,199

(22) Filed: Aug. 14, 2023

(65) Prior Publication Data

US 2024/0263903 A1 Aug. 8, 2024

Related U.S. Application Data

(60) Provisional application No. 63/443,459, filed on Feb. 6, 2023.

(51) Int. Cl.

| | |
|---|---|
| ***F41A 19/10*** | (2006.01) |
| ***F41A 17/06*** | (2006.01) |
| ***F41A 17/46*** | (2006.01) |
| ***F41A 19/08*** | (2006.01) |

(52) U.S. Cl.

CPC ..... *F41A 19/10* (2013.01); *F41A 17/063* (2013.01); *F41A 17/46* (2013.01); *F41A 19/08* (2013.01)

(58) Field of Classification Search

CPC ..... F41A 19/10; F41A 19/08; F41A 19/06; F41A 19/07; F41A 19/09; F41A 19/16; F41A 19/58; F41A 19/59; F41A 19/68; F41A 19/69; F41A 19/70; F41A 17/063; F41A 17/06

USPC ..... 42/69.01

See application file for complete search history.

(56) References Cited

U.S. PATENT DOCUMENTS

| | | | | |
|---|---|---|---|---|
| 2,410,100 | A * | 10/1946 | Oscar | F41A 19/58 89/27.11 |
| 4,718,187 | A * | 1/1988 | Blake | F41A 19/59 42/84 |
| 5,949,015 | A * | 9/1999 | Smith | F41G 3/22 89/41.09 |
| 7,650,826 | B2 * | 1/2010 | Son | F41A 23/24 89/27.3 |
| 8,434,397 | B1 * | 5/2013 | Deckard | F41A 9/60 89/37.16 |
| 10,890,407 | B1 * | 1/2021 | Archer | F41G 5/14 |
| 11,525,649 | B1 * | 12/2022 | Archer | F41G 5/16 |
| 2005/0263000 | A1 * | 12/2005 | Hill | F41A 27/30 89/136 |
| 2011/0042459 | A1 * | 2/2011 | Sullivan | F41G 5/06 235/407 |
| 2012/0174741 | A1 * | 7/2012 | Rogers | F41A 27/28 451/340 |
| 2020/0025488 | A1 * | 1/2020 | Alicea, Jr. | F41A 17/22 |

(Continued)

*Primary Examiner* — John Cooper
(74) *Attorney, Agent, or Firm* — Edward M. Bushard

(57) ABSTRACT

An apparatus for discharging a weapon includes a combination trigger that includes both a manual trigger and a remote trigger. The weapon may be discharged using either the manual trigger or remote trigger. The apparatus may also include a remote and/or manual safety to prevent the weapon from being discharged.

12 Claims, 9 Drawing Sheets

(56) References Cited

U.S. PATENT DOCUMENTS

2021/0239835 A1* 8/2021 Suk ..... F41G 3/06
2022/0341693 A1* 10/2022 Alvarez ..... F41A 19/59

* cited by examiner

TRIGGER ARRANGEMENT FOR MANUAL AND REMOTE FIRING

CROSS REFERENCE TO RELATED APPLICATION

Pursuant to 35 U.S.C. § 119, the benefit of priority from provisional application 63/344,459, with a filing date of Feb. 6, 2023, is claimed for this non-provisional application and assigned Navy Case 211181.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to weapons. In particular, converting weapons from manual firing to a combination of remote and manual firing. Weapon systems are increasingly being required to operate in "Optionally Manned" configurations. This requires adaptations to allow the weapon to be used either manually or via remote actuation. The subject trigger arrangement allows for both manual and remote firing of a weapon. Two means of depressing the weapon's Sear are provided: 1) a trigger, which functions in a typical fashion; and 2) a solenoid actuator, which is concentric with the trigger, and which is powered by an external Fire Control system. The weapons system may further include a safety interlock for the manual trigger is via mechanical safety. The safety interlock for the solenoid actuator is via an arming switch.

SUMMARY

An apparatus for discharging a weapon includes a combination trigger that includes both a manual trigger and a remote trigger. The weapon may be discharged using either the manual trigger or remote trigger. The apparatus may also include a remote and/or manual safety to prevent the weapon from being discharged.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
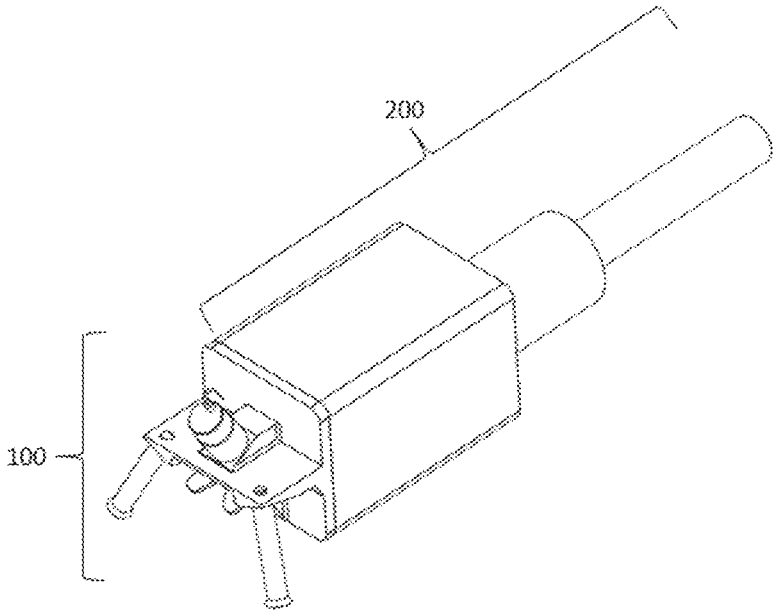
FIG. 1 shows a replacement back plate assembly attached to a receiver.

FIG. 1 shows a replacement back plate assembly 100 attached to a receiver 200. The replacement back plate assembly 100 is adaptable to multiple lethal and non-lethal weapon designs. The embodiment shown is designed to be used with a Mk 47 Striker which is a 40 mm automatic grenade launcher. However, one of ordinary skill in the art would be able to modify this device to operate any number of different weapons.

Figure 2:
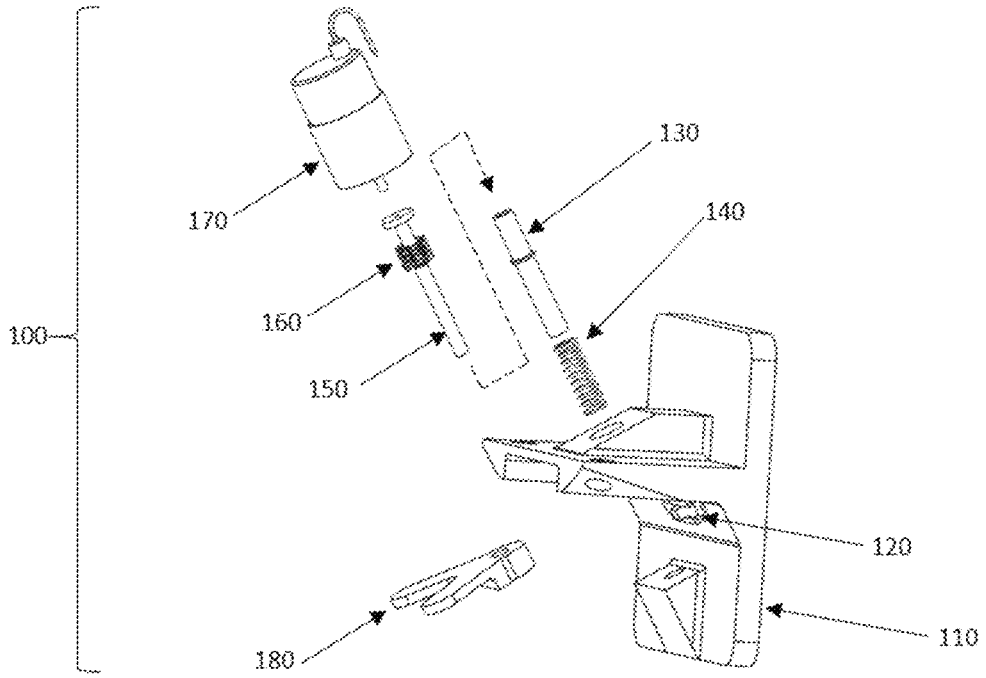
FIG. 2 is shows an exploded view of the replacement back plate assembly 100.

FIG. 2 shows an exploded view of the replacement back plate assembly 100. In this view the hand grips are hidden for clarity. In the embodiment shown, the replacement back plate assembly 100, includes a back plate 110, a manual safety 120, an outer pushrod 130, an outer pushrod return spring 140, an inner pushrod 150, an inner pushrod return spring 160, a solenoid 170, and a manual trigger 180. As shown in this embodiment, the back plate 110 is used to replace the original back plate (not shown). The interface between the back plate 110 and receiver 200 is sufficiently similar to the original interface to make replacement possible without the need to change the receiver 200. Further, the back plate 110 includes a manual safety 120 formed or attached on the back plate 110. This embodiment further includes an outer pushrod 130. In this embodiment, the outer pushrod 130 is used in conjunction with the manual trigger 180 to activate the device. This embodiment further includes a spring 140 that returns the outer pushrod 130 back to the standby position. This embodiment further includes an inner pushrod 150 that is used in conjunction with the solenoid 170 to activate the device when a remote signal is received by the device. This embodiment further includes a second spring 160 that returns the inner push rod 150 to a standby position. The remote signal may be received by the device in any number of ways known in the art.

Figure 3:
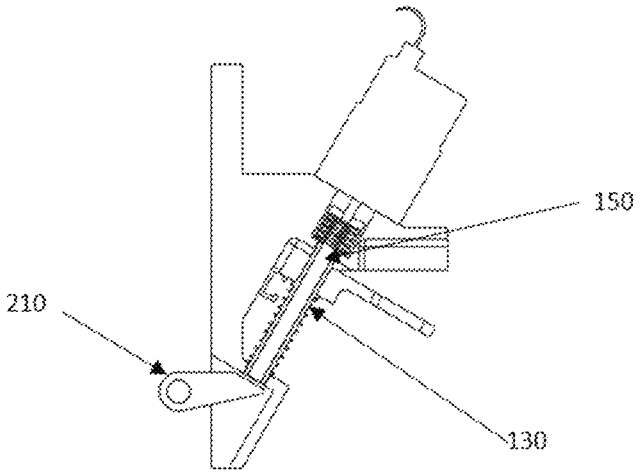
FIG. 3 shows a back plate assembly cross section shown at rest (non-firing or standby) state.

FIG. 3 shows a back plate assembly cross section shown at rest (non-firing or standby) state. In the standby state neither the inner pushrod 150 nor the outer pushrod 130 is acting on the sear 210. In the standby state, the device is ready to receive an input either remotely through the solenoid 170 or the manual trigger.

Figure 4:
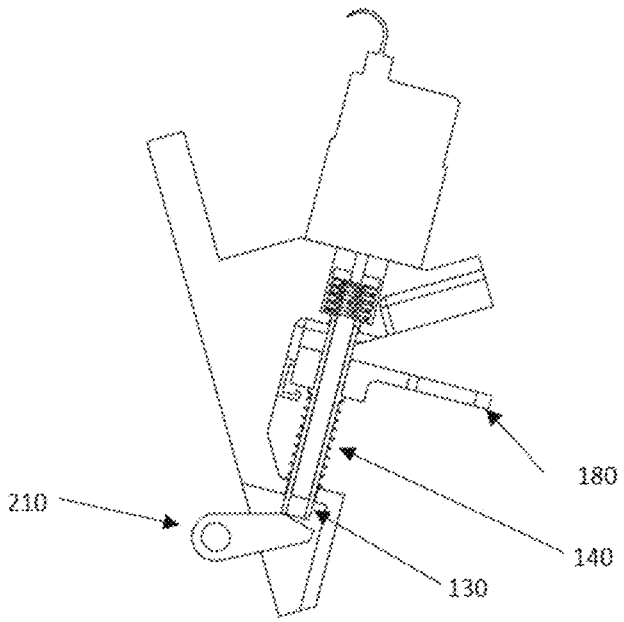
FIG. 4 shows the back plate assembly cross section depicted in the manual firing state.

FIG. 4 shows the back plate assembly cross section depicted in the manual firing state. In the manual firing state, the manual trigger 180 has been depressed which forces the outer pushrod 130 and compresses the outer pushrod return spring 180. The protruding tip of outer pushrod 130 is acting on Sear 210, causing the weapon to fire.

Figure 5:
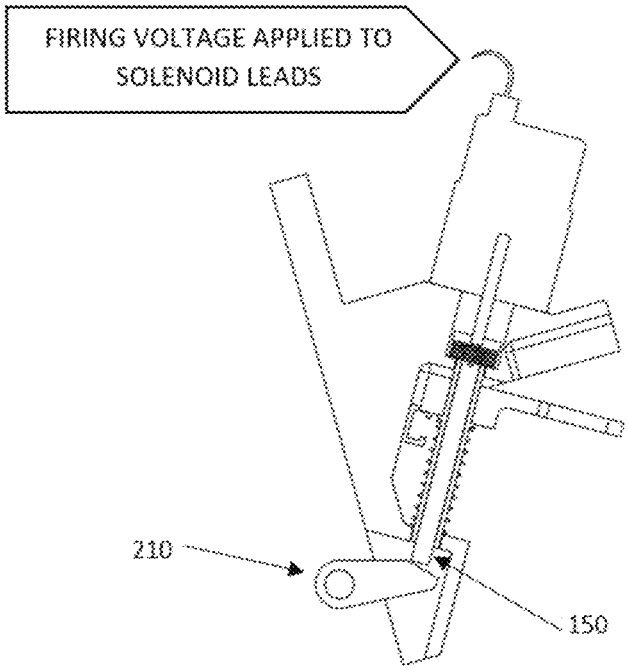
FIG. 5 shows the back plate assembly cross section depicted in the remote firing state.

FIG. 5 shows the back plate assembly cross section depicted in the remote firing state. In the remote firing state, the Solenoid 170 is energized by a firing circuit (not shown) and forces the inner pushrod 150 to extend. The tip of Inner Pushrod 150 protrudes and acts on the Sear 210.

Figure 6:
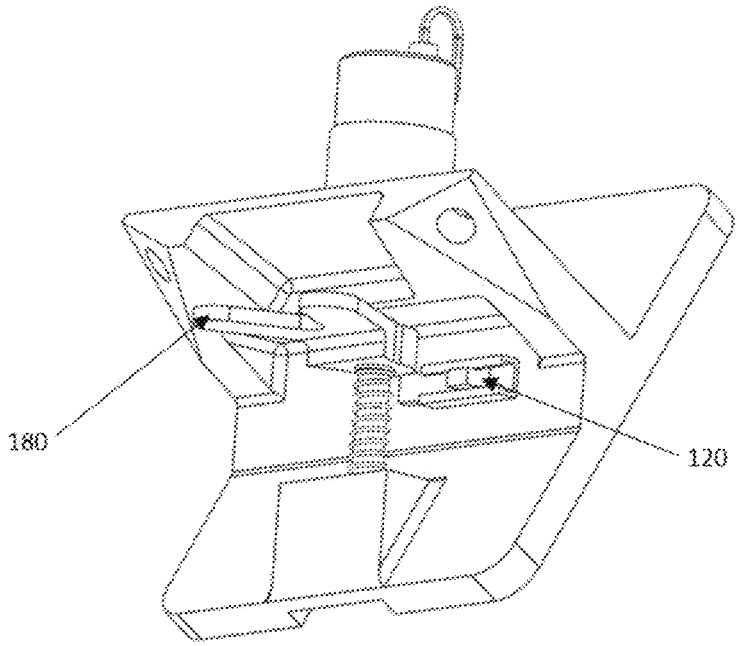
FIG. 6 shows the back plate assembly in manual safe mode.

FIG. 6 shows the back plate assembly in manual safe mode. The manual safety 120 is blocking the motion of the manual trigger 180. Any conventional method of mechanically blocking the trigger is adaptable to the invention.

Figure 7:
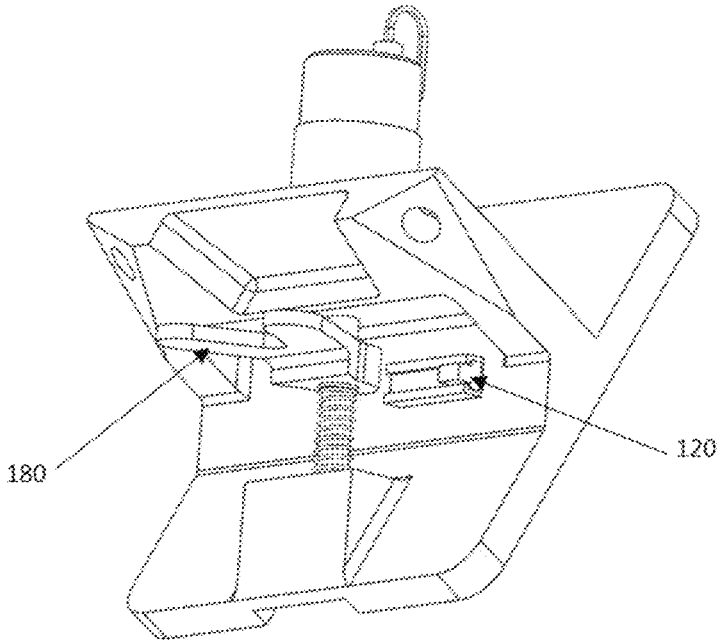
FIG. 7 shows the back plate assembly in a manual firing mode.

FIG. 7 shows the back plate assembly in a manual firing mode. The manual safety 120 has been moved out-of-line with manual trigger 180 and the Manual Trigger 180 is ready to be depressed. Any conventional method of mechanically blocking the trigger is adaptable to the invention.

Figure 8:
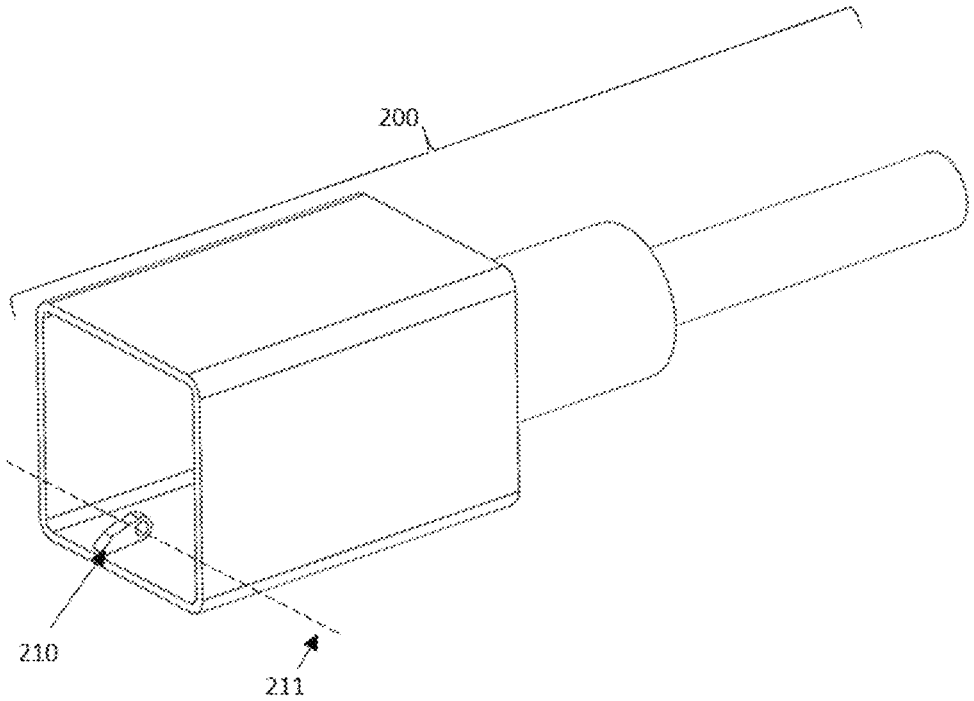
FIG. 8 shows the receiver assembly.

FIG. 8 shows the receiver assembly 200. The invention is applicable to multiple firearms each having its own peculiar design. For context, receiver assembly 200 with pivoting sear 210 is shown as a visual reference. A common design for a sear 210 that rotates about axis 211 to initiate the firing of the weapon. The object of the invention is to provide dual means of causing the sear to rotate (manual and via a remote firing voltage).

Figure 9:
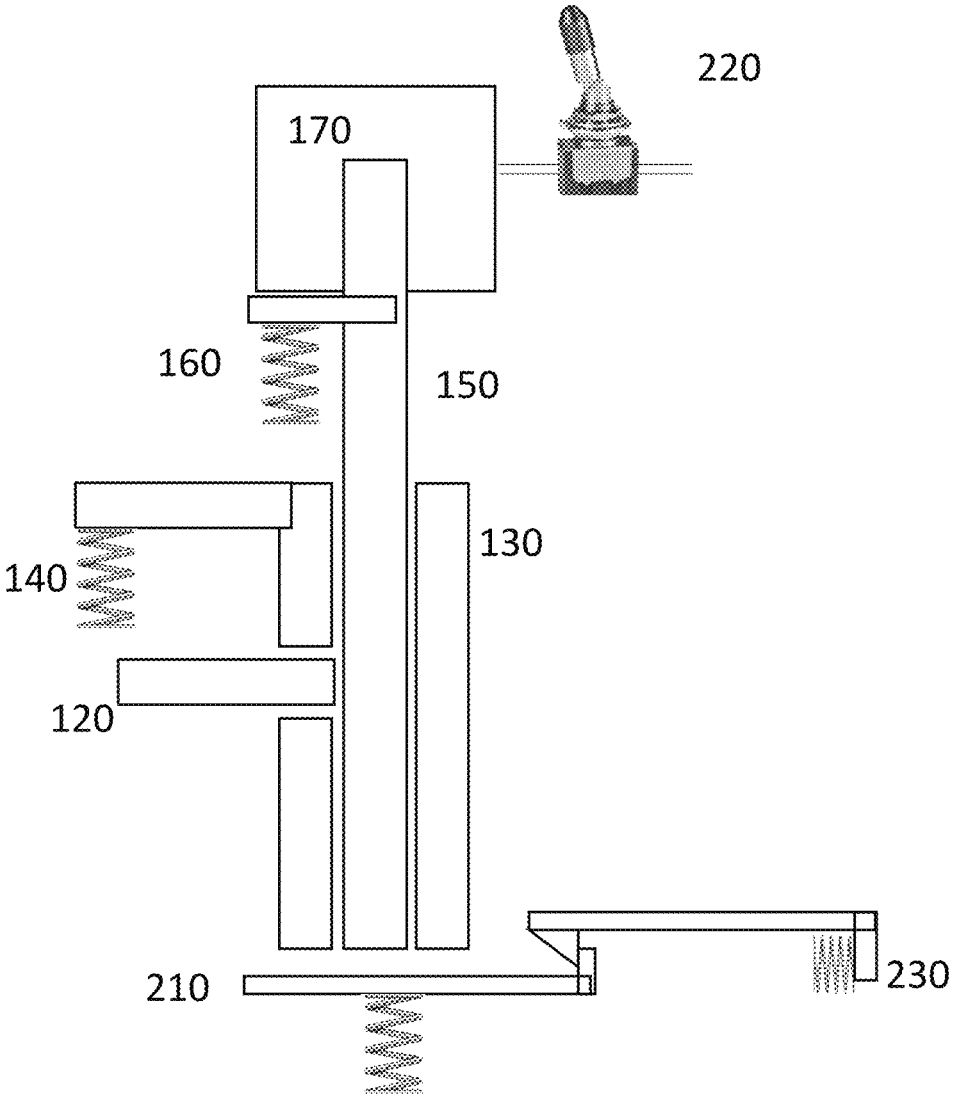
FIG. 9 shows a schematic of the device.

FIG. 9 shows a schematic of the device. In this view, the remote trigger safety is an arming switch 220 that may also be mounted on the back plate assembly. As shown in this view, the arming switch 220 is toggled either on or off which connects or disconnects the solenoid from the remote firing circuit (not shown). When the remote firing signal is received and the arming switch 220 is toggled on, the solenoid 170 engages the push rod 150 to activate the sear 210 which releases the firing pin 230 which then discharges the weapon.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus for discharging a weapon comprising:
a combination trigger further comprising;
a manual trigger; and
a remote trigger;
wherein the weapon is discharged by either the manual trigger or remote trigger and wherein the remote trigger further comprises a pushrod that is concentrically disposed within the manual trigger.

2. The apparatus according to claim 1, wherein the remote trigger further comprises a solenoid which is activated by a firing voltage to actuate a pushrod.

3. The apparatus according to claim 1, wherein the remote trigger further comprises an arming switch that which energizes the remote trigger enabling both manual and remote operation.

4. The apparatus according to claim 1, wherein the manual trigger further comprises a manual trigger return spring.

5. The apparatus according to claim 1, wherein the manual trigger further comprises a manual trigger safety.

6. The apparatus according to claim 1, wherein the remote trigger further comprises a remote trigger safety to prevent a remote discharge of the weapon while allowing the weapon to be fired manually.

7. The apparatus according to claim 1, wherein the remote trigger further comprises a remote trigger return spring.

8. The apparatus according claim 1, where the remote trigger further comprises a remote trigger safety that physically prevents the pushrod from discharging the weapon.

9. The apparatus according to claim 8, wherein the remote trigger safety is an arming switch.

10. The apparatus according to claim 1, wherein either the remote trigger or the manual trigger engages with a sear to release a hammer to discharge the weapon.

11. The apparatus according to claim 1, further comprising:
a replacement back plate for receiving the combination trigger wherein the replacement back plate replaces the original back plate of the weapon.

12. An apparatus for discharging a weapon comprising:
a combination trigger further comprising;
a manual trigger; and
a remote trigger;
wherein the weapon is discharged by either the manual trigger or remote trigger and wherein the remote trigger further comprises a pushrod that is concentrically disposed about the manual trigger.

* * * * *